US009884400B2

(12) United States Patent
Feng et al.

(10) Patent No.: US 9,884,400 B2
(45) Date of Patent: Feb. 6, 2018

(54) POLISHING PAD AND METHOD FOR MAKING THE SAME

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Wen-Chieh Wu, Kaohsiung (TW); Hsin-Ru Song, Kaohsiung (TW)

(73) Assignee: SAN FANG CHEMICAL INDUSTRY CO., LTD, Kaohsiung (TW)

( * ) Notice: Subject to any disclaimer, the term of this patent is extended or adjusted under 35 U.S.C. 154(b) by 11 days.

(21) Appl. No.: 14/872,370

(22) Filed: Oct. 1, 2015

(65) Prior Publication Data

US 2016/0199961 A1 Jul. 14, 2016

(30) Foreign Application Priority Data

Jan. 12, 2015 (TW) ..... 104100992 A

(51) Int. Cl.
*B24B 37/20* (2012.01)
*B24D 3/28* (2006.01)
*B24D 18/00* (2006.01)

(52) U.S. Cl.
CPC ..... *B24B 37/20* (2013.01); *B24D 3/28* (2013.01); *B24D 18/0027* (2013.01)

(58) Field of Classification Search
CPC .. B24B 7/22; B24B 37/20; B24B 3/28; B24B 18/0027; B24B 18/00
USPC ..... 451/526, 527, 529, 530, 533, 534, 538, 451/539; 51/297, 298
See application file for complete search history.

(56) References Cited

U.S. PATENT DOCUMENTS 5,533,923 A * 7/1996 Shamouilian ..... B24B 37/26 451/36
5,795,218 A * 8/1998 Doan ..... B24D 11/00 451/526
6,239,188 B1 * 5/2001 Kihara ..... B24B 37/11 521/137
6,623,331 B2 * 9/2003 Sevilla ..... B24B 37/013 451/533
7,182,672 B2 2/2007 Tunaboylu et al.
(Continued)

FOREIGN PATENT DOCUMENTS

CN 101495272 A 7/2009
JP 2014-65119 A 4/2014
(Continued)

OTHER PUBLICATIONS

Office action and search report for the counterpart Taiwan Patent Application No. 104100992 dated Aug. 11, 2015 by Taiwan Patent Office.

(Continued)

*Primary Examiner* — Robert Rose
(74) *Attorney, Agent, or Firm* — WPAT, P.C., Intellectual Property Attorneys; Anthony King

(57) ABSTRACT

The present invention relates to a polishing pad and a method for making the same. The polishing pad includes a polymeric elastomer and a plurality of hollow structures. The hollow structures are distributed in the polymeric elastomer uniformly, and the sizes of the hollow structures are substantially equal to each other.

5 Claims, 12 Drawing Sheets

(56) References Cited

U.S. PATENT DOCUMENTS

| | | | | |
|---|---|---|---|---|
| 8,016,647 | B2 * | 9/2011 | Chang | B24B 37/20 451/526 |
| 2005/0079806 | A1 * | 4/2005 | James | B24B 37/24 451/41 |
| 2007/0066195 | A1 * | 3/2007 | Duong | B24B 37/24 451/526 |

FOREIGN PATENT DOCUMENTS

| | | | |
|---|---|---|---|
| KR | 10-2005-0070418 | A | 7/2005 |
| TW | 200414974 | A | 8/2004 |
| TW | I222390 | | 10/2004 |
| TW | 201006854 | A | 2/2010 |

OTHER PUBLICATIONS

English translation of the search report for the counterpart Taiwan Patent Application No. 104100992 dated Aug. 11, 2015 by Taiwan Patent Office.
English abstract translation of TWI 222390.
English abstract translation of TW 200414974 A.
English abstract translation of TW 201006854 A.
Office action and search report for the counterpart China Patent Application No. 201510080926.0 dated Oct. 24, 2017 by SIPO (State Intellectual Property Office of China).
English translation of the search report for the counterpart China Patent Application No. 201510080926.0 dated Oct. 24, 2017 by SIPO (State Intellectual Property Office of China).
English abstract translation of JP 2014-65119A.
English abstract translation of KR10-2005-0070418A.
English abstract translation of CN101495272A.

* cited by examiner

POLISHING PAD AND METHOD FOR MAKING THE SAME

BACKGROUND OF THE INVENTION

1. Field of the Invention

The present invention relates to a polishing pad and a method for making the same, and more particularly, to a polishing pad having hollow structures and a method for making the same.

2. Description of the Related Art

FIG. 1 and FIG. 2 are schematic views of a method for making a conventional polishing pad. The method for making the conventional polishing pad is as follows. A resin 10 (usually a thermoplastic polyurethane polymeric foam) is infused into a mold cylinder, to form a bulk 11 after cooling and solidification. As shown in FIG. 1, the bulk 11 has a plurality of cells 12. Then, referring to FIG. 2, the bulk 11 is cut along a plurality of cutting lines 13 to form a plurality of polishing pads 14. The polishing pads 14 have independent bubble structures, and are usually used in high planarization polishing. However, the main problem of the polishing pads 14 lies in that, because the concentration distribution of the resin 10 in the mold cylinder is less uniform, during molding, the difference between temperature distributions in various positions of the mold cylinder may result in that the cells 12 have different sizes and distributions and the cells 12 are not easy to control. Thus, after a slicing process, the different sizes of the cells 12 on the slicing surfaces of the polishing pads 14 will become more obvious. During the grinding process, a grinding slurry permeates into large-aperture cells and small-aperture cells by different degrees, which will cause nonuniform grinding and deposition of the grinding slurry, thus easily producing grinding defects.

Therefore, it is necessary to provide an innovative and progressive polishing pad and a method for making the same, so as to solve the above problems.

SUMMARY OF THE INVENTION

The present invention provides a polishing pad. The polishing pad comprises a polymeric elastomer and a plurality of hollow structures. The hollow structures are uniformly distributed in the polymeric elastomer, and the sizes of the hollow structures are substantially equal to each other. Thereby, during the polishing process, when the hollow structures have broken holes, or the hollow structures are all removed to leave cells, the grinding slurry permeates into the polishing pad by the same degree, which thus can improve the grinding effect.

The present invention further provides a method for making a polishing pad. The method comprises the steps of: (a) mixing a plurality of hollow structures into a polymeric resin, wherein the sizes of the hollow structures are substantially equal to each other, and the hollow structures are distributed in the polymeric elastomer uniformly; (b) coating a portion of the polymeric resin onto a carrier, to form a first polymeric layer, wherein the first polymeric layer comprises at least one row of hollow structures; (c) curing the first polymeric layer; (d) coating a portion of the polymeric resin onto the first polymeric layer, to form a second polymeric layer, wherein the second polymeric layer comprises at least one row of hollow structures; (e) curing the second polymeric layer; and (f) repeating the steps (d) to (e) at least once, to form a polishing pad.

The present invention further provides a method for making a polishing pad. The method comprises the steps of: (a) providing a polymeric resin, and coating a portion of the polymeric resin onto a carrier, to form a first polymeric layer; (b) embedding a plurality of first hollow structures to an upper surface of the first polymeric layer, such that a lower portion of each of the first hollow structures is located in the first polymeric layer, and an upper portion of each of the first hollow structures is exposed from the first polymeric layer, wherein the sizes of the first hollow structures are substantially equal to each other, and the first hollow structures are distributed on the upper surface of the first polymeric layer uniformly; (c) curing the first polymeric layer; (d) coating a portion of the polymeric resin onto the first polymeric layer, to form a second polymeric layer, wherein the second polymeric layer covers the first hollow structures; (e) embedding a plurality of second hollow structures to an upper surface of the second polymeric layer, such that a lower portion of each of the second hollow structures is located in the second polymeric layer, and an upper portion of each of the second hollow structure is exposed from the second polymeric layer, wherein the sizes of the second hollow structures are substantially equal to each other, and the second hollow structures are distributed on the upper surface of the second polymeric layer uniformly; (f) curing the second polymeric layer; and (g) repeating the steps (d) to (f) at least once, to form a polishing pad.

DETAILED DESCRIPTION OF THE PRESENT INVENTION

Figure 1:
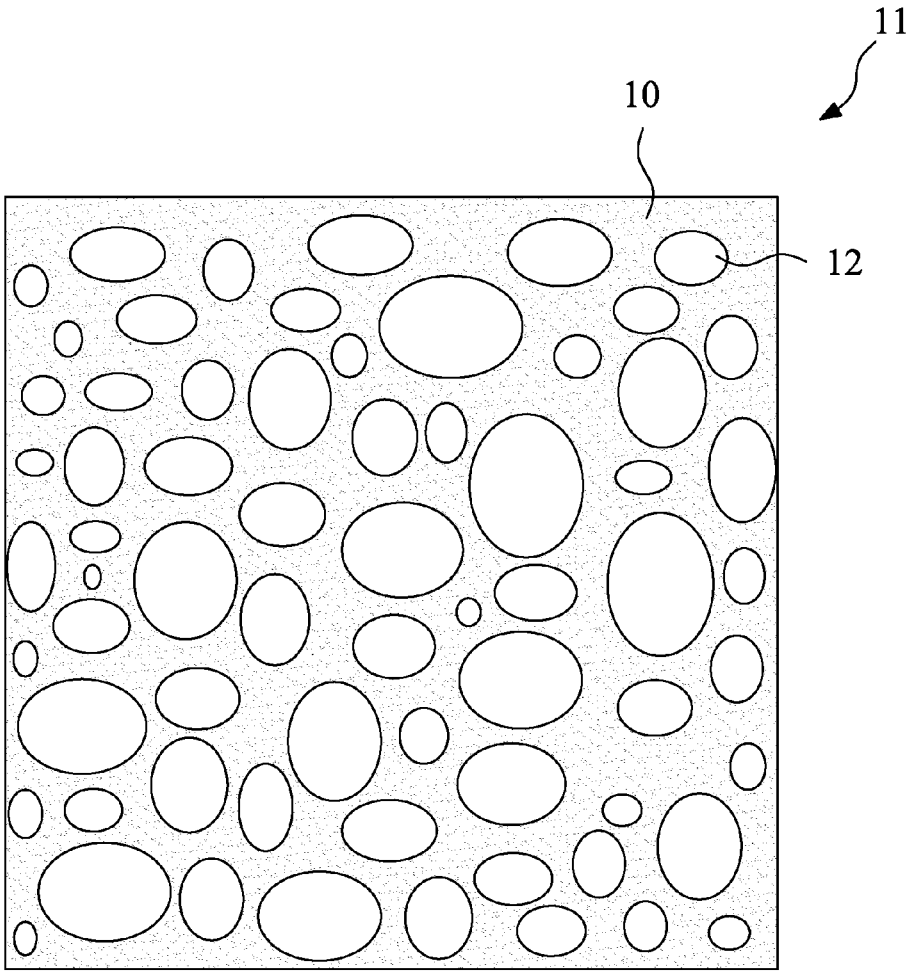
FIG. 1 and FIG. 2 are schematic views of a method for making a conventional polishing pad.
Figure 2:
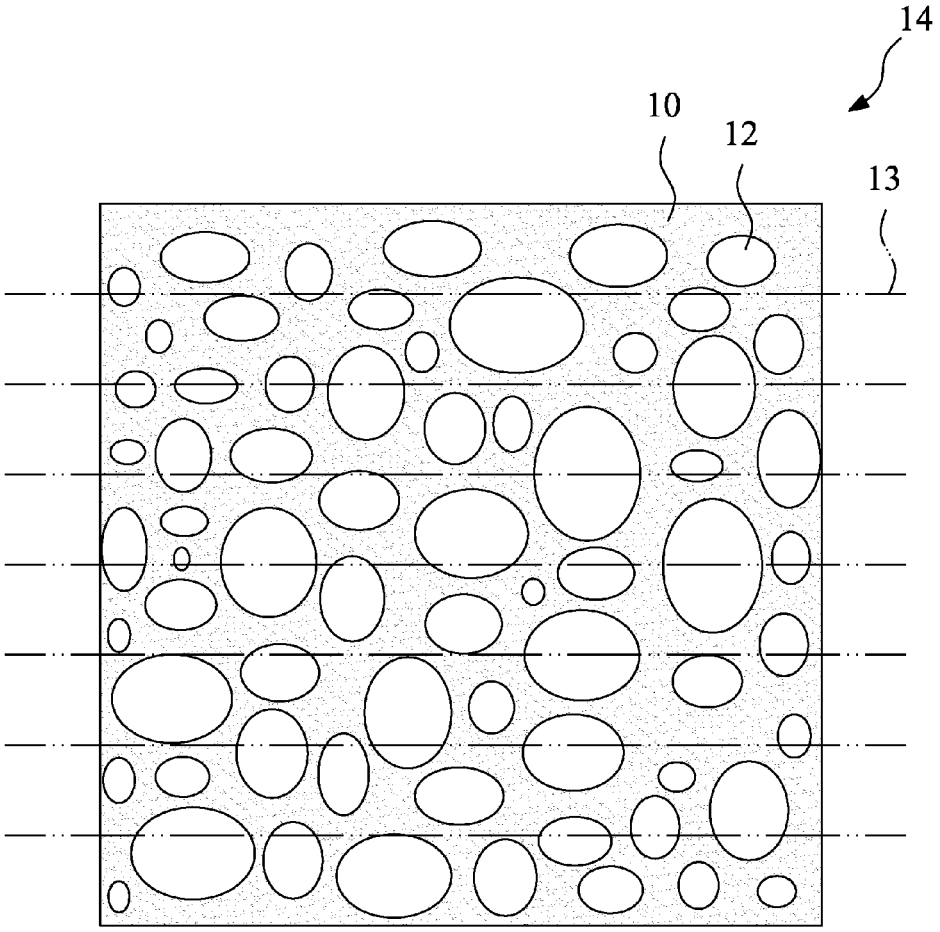
Figure 3:
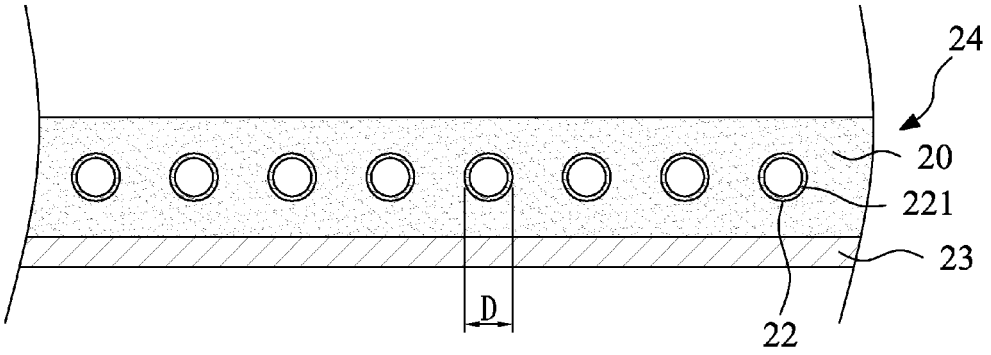
FIG. 3 to FIG. 6 are schematic views of process steps of a method for making a polishing pad according to an embodiment of the present invention.

FIG. 3 to FIG. 6 are schematic views of process steps of a method for making a polishing pad according to an embodiment of the present invention. Referring to FIG. 3, a plurality of hollow structures 22 are mixed into a polymeric resin 20, where the sizes D of the hollow structures 22 are substantially equal to each other, and the hollow structures 22 are distributed in the polymeric resin 20 uniformly. The material of the polymeric resin 20 is selected from the group consisting of polyamide resin, polycarbonate, polymethacrylic resin, epoxy resin, phenolic resin, polyurethane resin, vinylbenzene resin and acrylic resin, and the material of the hollow structures 22 is waterborne polyurethane or acrylic resin. In this embodiment, the material of the polymeric resin 20 is acrylic resin, for example, epoxy acrylate, urethane acrylate, polyester acrylate or polyether acrylate. The material of the hollow structures 22 is waterborne polyurethane.

In this embodiment, each of the hollow structures 22 is a capsule-like structure, which has a closed space formed by a shell 221. Preferably, the hollow structures 22 are spherical. The sizes D of the hollow structures 22 range from 10 μm to 100 μm, and the size variation between the hollow structures 22 is within 20%. In this embodiment, the sizes D of the hollow structures 22 range from 30 μm to 40 μm. In this embodiment, the hollow structures 22 are first treated to be charged. In this embodiment, the hollow structures 22 are charged through electrospray extrusion injection, and an implementation mode thereof is as follows. At first, a metal capillary is provided, where the metal capillary has a spray nozzle. At the same time, a corresponding electrode is placed in a position at a distance of 1 cm to 2 cm from an outlet of the spray nozzle. Next, a sample of an aqueous solution containing the hollow structures 22 is injected to the metal capillary, and thousands of volts of potential difference (the voltage is preferably 5-30 kV, and is more preferably 10-20 kV) is applied between the metal capillary and the corresponding electrode. In this way, when being sprayed from the spray nozzle, the hollow structures 22 will be charged.

Next, a portion of the polymeric resin 20 is coated (for example, blade coating) onto a carrier 23, to form a first polymeric layer 24. The first polymeric layer 24 includes at least one row of hollow structures 22. In this embodiment, the thickness of the first polymeric layer 24 is very thin through blade coating and by controlling appropriate process parameters, so that the first polymeric layer 24 only includes one row of hollow structures 22. Because the hollow structures 22 have already undergone through the above-mentioned electrospray extrusion injection, the hollow structures 22 have positive charge on the surfaces thereof. As like charges repel, the hollow structures 22 may be arranged in the first polymeric layer 24, but aggregation or coagulation will not occur. Preferably, the hollow structures 22 are located in central positions of the first polymeric layer 24. It can be understood that horizontal positions of the hollow structures 22 may slightly deviate from each other, that is, some hollow structures 22 may be higher while some may be lower.

In another embodiment, whether the hollow structures 22 are charged or not, after the polymeric resin 20 is coated, a flat scraper can be used to scrape excessive polymeric resin 20 and hollow structures 22 by controlling appropriate process parameters, such that the first polymeric layer 24 only includes one row of hollow structures 22.

Next, the first polymeric layer 24 is cured or hardened through irradiation of UV light or heating. In this embodiment, the first polymeric layer 24 is cured through irradiation of UV light, and the irradiation time is 1 minute to 1 hour. The polymeric resin 20 is cured or hardened through bonding of two bonds in oligomer and monomer thereof.

Figure 4:
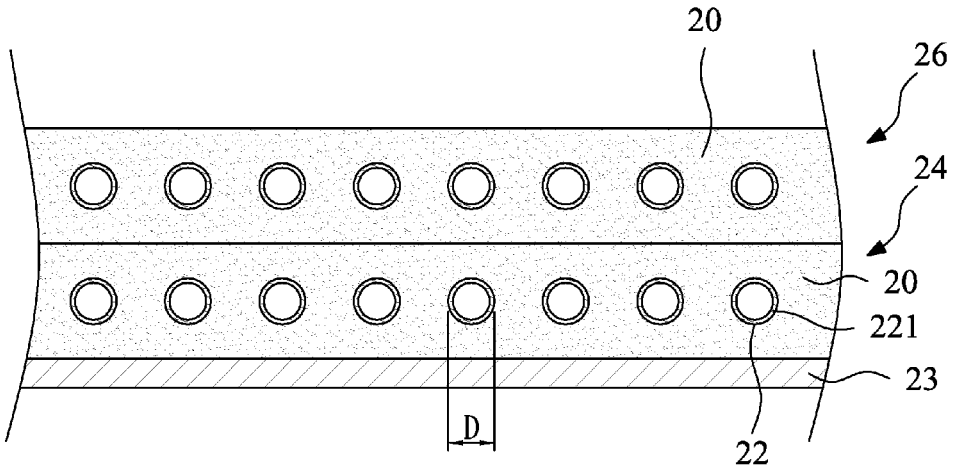

Referring to FIG. 4, a portion of the polymeric resin 20 is coated (for example, blade coating) onto the first polymeric layer 24, to form a second polymeric layer 26, where the second polymeric layer 26 includes at least one row of hollow structures 22. In this embodiment, the second polymeric layer 26 includes one row of hollow structures 22, and the hollow structures 22 are arranged in the second polymeric layer 26 in a same manner as that in which the hollow structures 22 are arranged in the first polymeric layer 24. Preferably, the hollow structures 22 are located in central positions of the second polymeric layer 26.

Next, the second polymeric layer 26 is cured or hardened through irradiation of UV light or heating. In this embodiment, the second polymeric layer 26 is cured or hardened through irradiation of UV light, and the irradiation time is 1 minute to 1 hour. The polymeric resin 20 is cured or hardened through bonding of two bonds in oligomer and monomer thereof.

Figure 5:
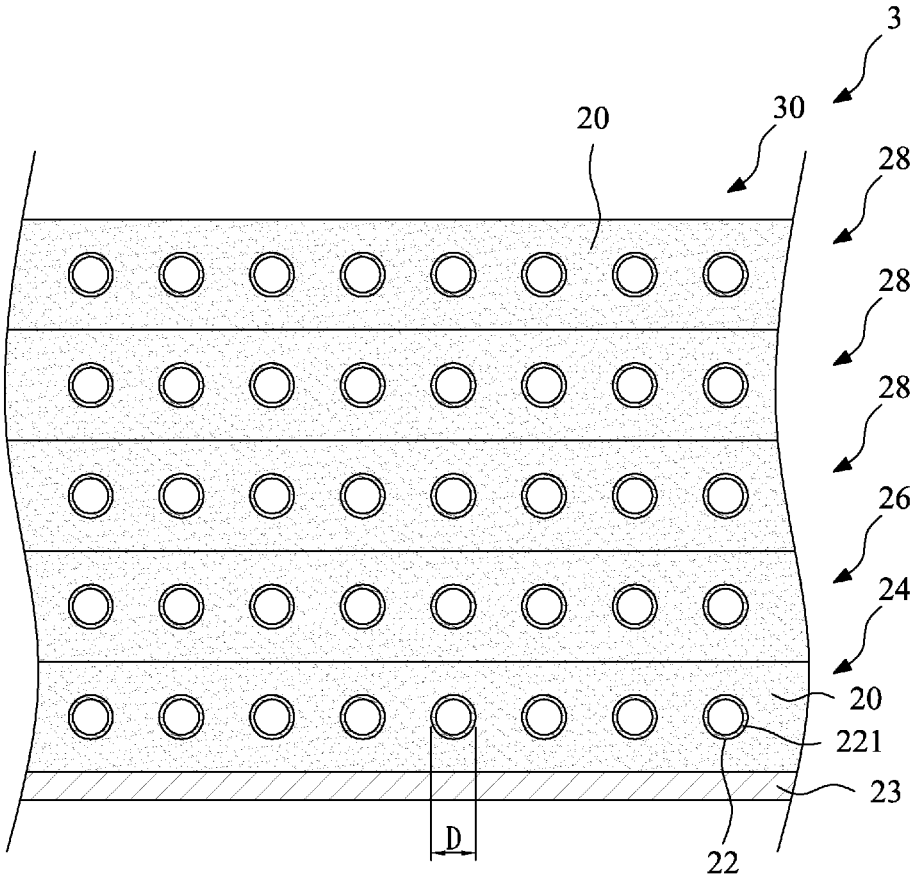

Referring to FIG. 5, the steps in FIG. 4 are repeated at least once, to form at least one polymeric layer 28 on the second polymeric layer 26, where the polymeric layers 24, 26 and 28 form a polymeric elastomer 30, and the materials of the polymeric layers 24, 26 and 28 may be the same or different.

Figure 6:
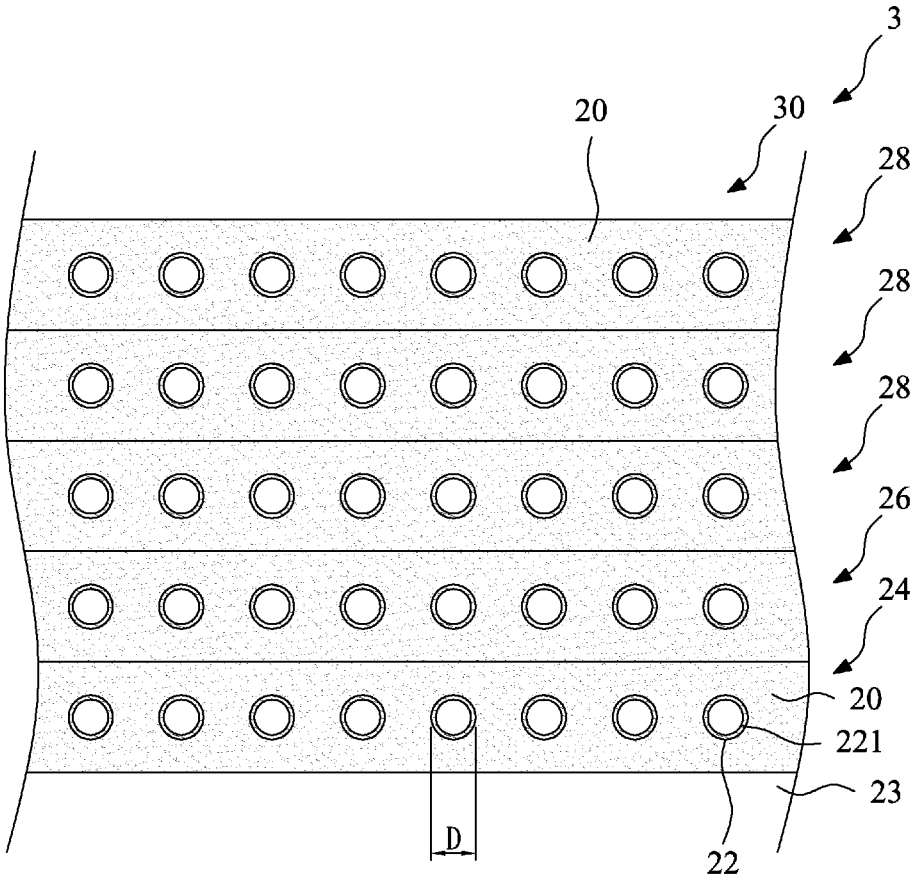

Referring to FIG. 6, the carrier 23 is removed, to form a polishing pad 3.

FIG. 6 is a schematic cross-sectional view of a polishing pad according to an embodiment of the present invention. The polishing pad 3 comprises a polymeric elastomer 30 and a plurality of hollow structures 22. The hollow structures 22 are uniformly distributed in the polymeric elastomer 30, and the sizes D of the hollow structures 22 are substantially equal to each other. In this embodiment, the polymeric elastomer 30 is formed by curing a polymeric resin 20. The material of the polymeric resin 20 is selected from the group consisting of polyamide resin, polycarbonate, polymethacrylic resin, epoxy resin, phenolic resin, polyurethane resin, vinylbenzene resin and acrylic resin, and the material of the hollow structures 22 is waterborne polyurethane or acrylic resin. In this embodiment, the material of the polymeric resin 20 is acrylic resin, for example, epoxy acrylate, urethane acrylate, polyester acrylate or polyether acrylate. The material of the hollow structures 22 is waterborne polyurethane.

In this embodiment, each of the hollow structures 22 is a capsule-like structure, which has a closed space formed by a shell 221. Preferably, the hollow structures 22 are spherical. The sizes D of the hollow structures 22 range from 10 μm to 100 μm, and the size variation between the hollow structures 22 is within 20%. In this embodiment, the sizes D of the hollow structures 22 range from 30 μm to 40 μm. In this embodiment, the hollow structures 22 are charged.

In this embodiment, the polymeric elastomer 30 includes a plurality of polymeric layers 24, 26 and 28. Each of the polymeric layers 24, 26 and 28 includes one row of hollow structures 22. The row of hollow structures 22 are located in central positions of each of the polymeric layers 24, 26 and 28.

Figure 7:
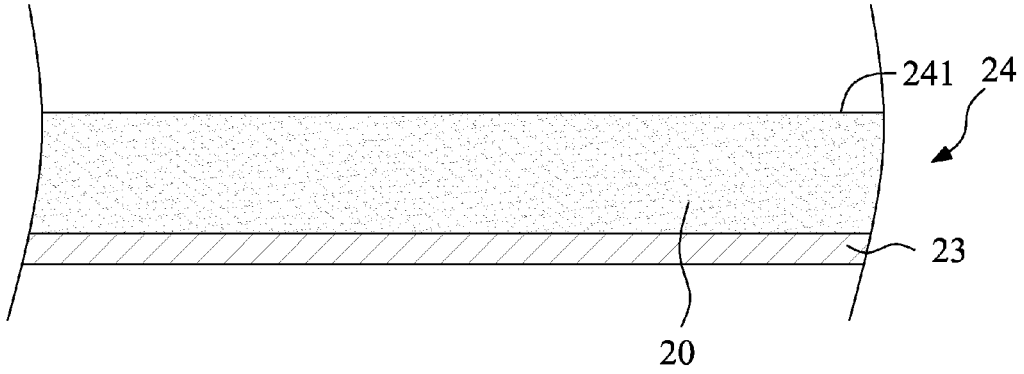
FIG. 7 to FIG. 12 are schematic views of process steps of a method for making a polishing pad according to another embodiment of the present invention.

During polishing process, as the hollow structures 22 have substantially the same sizes and are uniformly distributed in the polishing pad 3, when the hollow structures 22 have broken holes (meanwhile, the hollow structures 22 are cells), or the hollow structures 22 are all removed to leave cells, the grinding slurry permeates into the polishing pad 3 by the same degree, which thus can improve the grinding effect. In other words, the cells of the polishing pad 3 are not formed through foaming FIG. 7 to FIG. 12 are schematic views of process steps of a method for making a polishing pad according to another embodiment of the present invention. Referring to FIG. 7, a polymeric resin 20 is provided. The material of the polymeric resin 20 is selected from the group consisting of polyamide resin, polycarbonate, polymethacrylic resin, epoxy resin, phenolic resin, polyurethane resin, vinylbenzene resin and acrylic resin. In this embodiment, the material of the polymeric resin 20 is acrylic resin, for example, epoxy acrylate, urethane acrylate, polyester acrylate or polyether acrylate.

Next, a portion of the polymeric resin 20 is coated (for example, blade coating) onto a carrier 23, to form a first polymeric layer 24.

Figure 8:
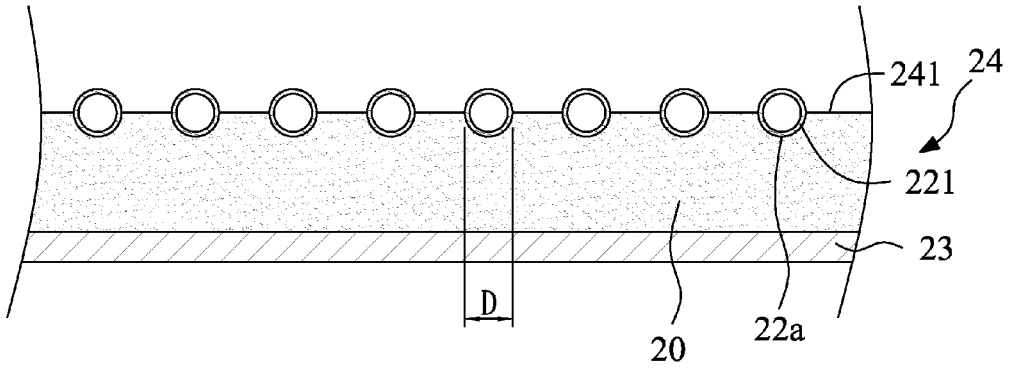

Referring to FIG. 8, a plurality of first hollow structures **22*a* are embedded to an upper surface 241 of the first polymeric layer 24, such that a lower portion of each of the first hollow structures 22*a* is located in the first polymeric layer 24, and an upper portion of each of the first hollow structures 22*a* is exposed from the first polymeric layer 24. In this embodiment, the first hollow structures 22*a* are charged through the above-mentioned electrospray extrusion injection. The first hollow structures 22***a* are sprayed from the spray nozzle to the upper surface 241 of the first polymeric layer 24before the first polymeric layer 24 is cured. Meanwhile, since the first polymeric layer 24 has not been cured, the first hollow structures 22*a* are embedded to the upper surface 241 of the first polymeric layer 24 due to the gravity thereof.

The sizes D of the first hollow structures 22*a* are substantially equal to each other, and the first hollow structures 22*a* are distributed on the upper surface 241 of the first polymeric layer 24 uniformly. In this embodiment, each of the first hollow structures 22*a* is a capsule-like structure, which has a closed space formed by a shell 221. Preferably, the first hollow structures 22*a* are spherical. The sizes D of the first hollow structures 22*a* range from 10 μm to 100 μm, and the size variation between the first hollow structures 22*a* is within 20%. In this embodiment, the sizes D of the first hollow structures 22*a* range from 30 μm to 40 μm. The material of the first hollow structures 22*a* is waterborne polyurethane or acrylic resin. In this embodiment, the material of the first hollow structures 22*a* is waterborne polyurethane.

Next, the first polymeric layer 24 is cured or hardened through irradiation of UV light or heating. In this embodiment, the first polymeric layer 24 is cured through irradiation of UV light, and the irradiation time is 1 minute to 1 hour. The polymeric resin 20 is cured or hardened through bonding of two bonds in oligomer and monomer thereof.

Figure 9:
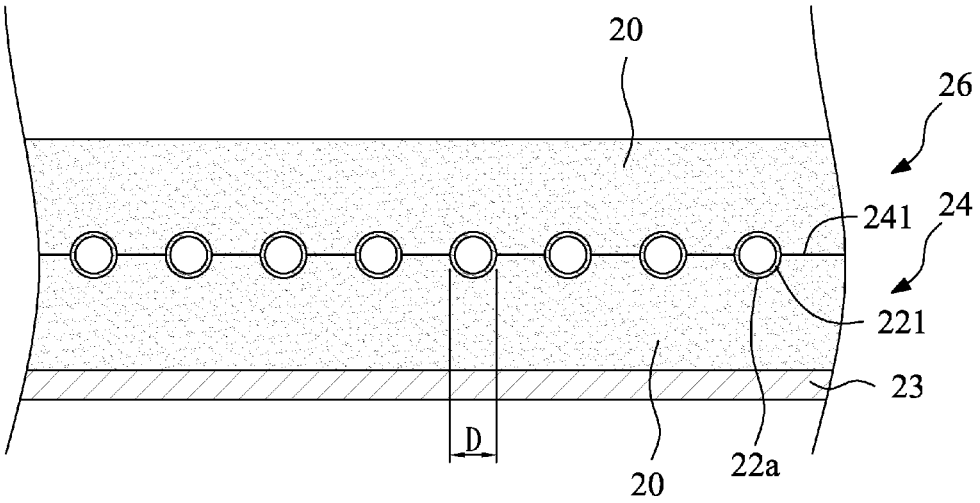

Referring to FIG. 9, a portion of the polymeric resin 20 is coated (for example, blade coating) on the first polymeric layer 24, to form a second polymeric layer 26. The second polymeric layer 26 covers the upper surface 241 of the first polymeric layer 24 and the first hollow structures 22*a*.

Figure 10:
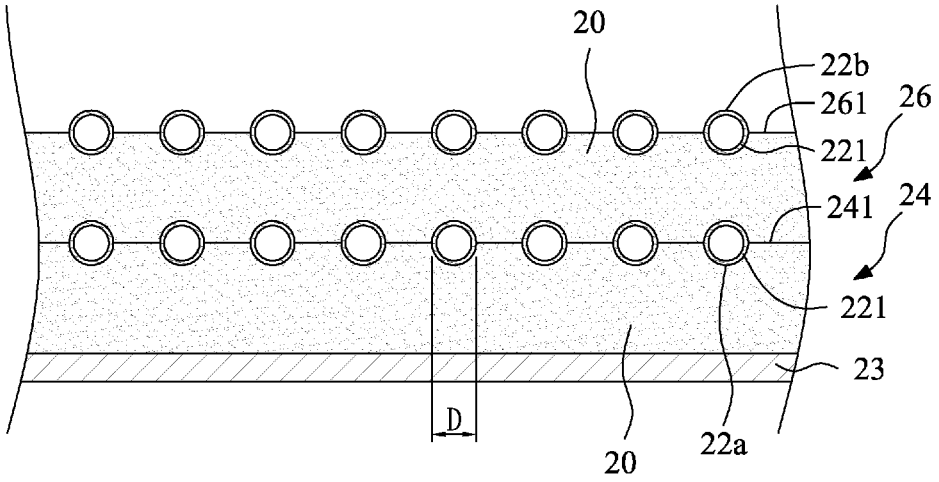

Referring to FIG. 10, a plurality of second hollow structures 22*b* are embedded to an upper surface 261 of the second polymeric layer 26, such that a lower portion of each of the second hollow structures 22*b* is located in the second polymeric layer 26, and an upper portion of each of the second hollow structures 22*b* is exposed from the second polymeric layer 26. In this embodiment, the second hollow structures 22*b* are charged through the above-mentioned electrospray extrusion injection. The second hollow structures 22*b* are sprayed from the spray nozzle to the upper surface 261 of the second polymeric layer 26 before the second polymeric layer 26 is cured. Meanwhile, since the second polymeric layer 26 has not been cured, the second hollow structures 22*b* are embedded to the upper surface 261 of the second polymeric layer 26 due to the gravity thereof. The sizes D of the second hollow structures 22*b* are substantially equal to each other, and the second hollow structures 22*b* are distributed on the upper surface 261 of the second polymeric layer 26 uniformly. The second hollow structures 22*b* may be same as or different from the first hollow structures 22*a*.

Next, the second polymeric layer 26 is cured or hardened through irradiation of UV light or heating. In this embodiment, the second polymeric layer 26 is cured through irradiation of UV light, and the irradiation time is 1 minute to 1 hour.

Figure 11:
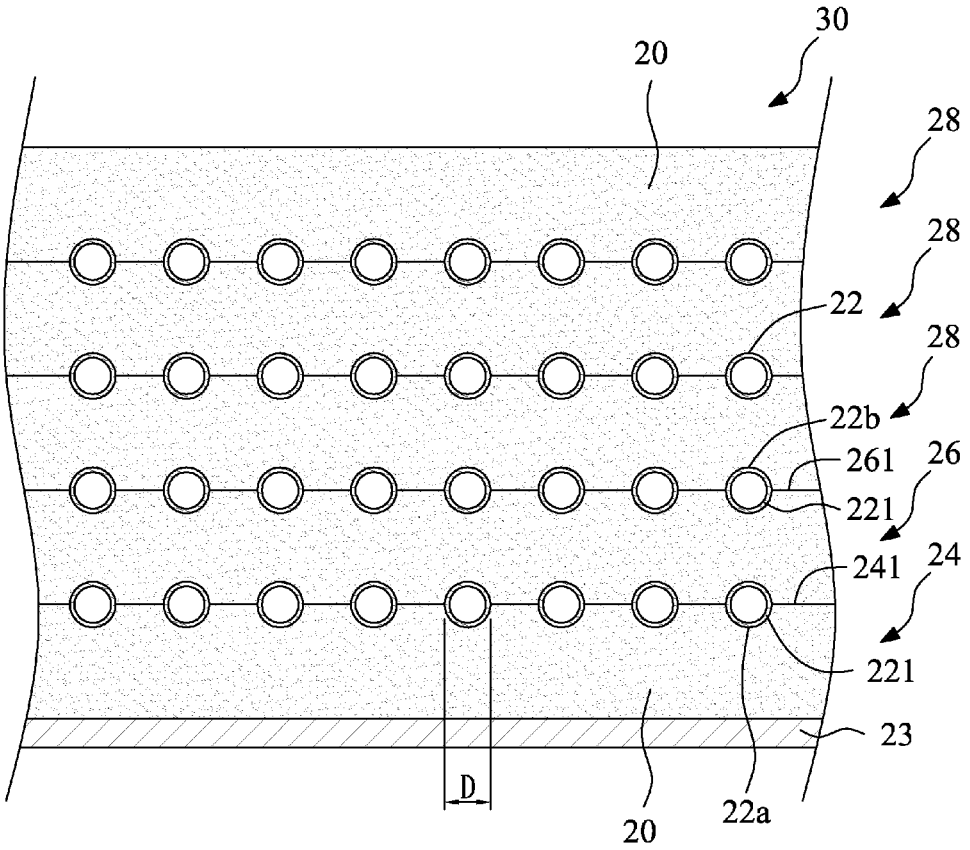

Referring to FIG. 11, the steps in FIG. 9 and FIG. 10 are repeated at least once, to form at least one polymeric layer 28 on the second polymeric layer 26, where the polymeric layers 24, 26 and 28 form a polymeric elastomer 30, and the materials of the polymeric layers 24, 26 and 28 may be the same or different.

Figure 12:
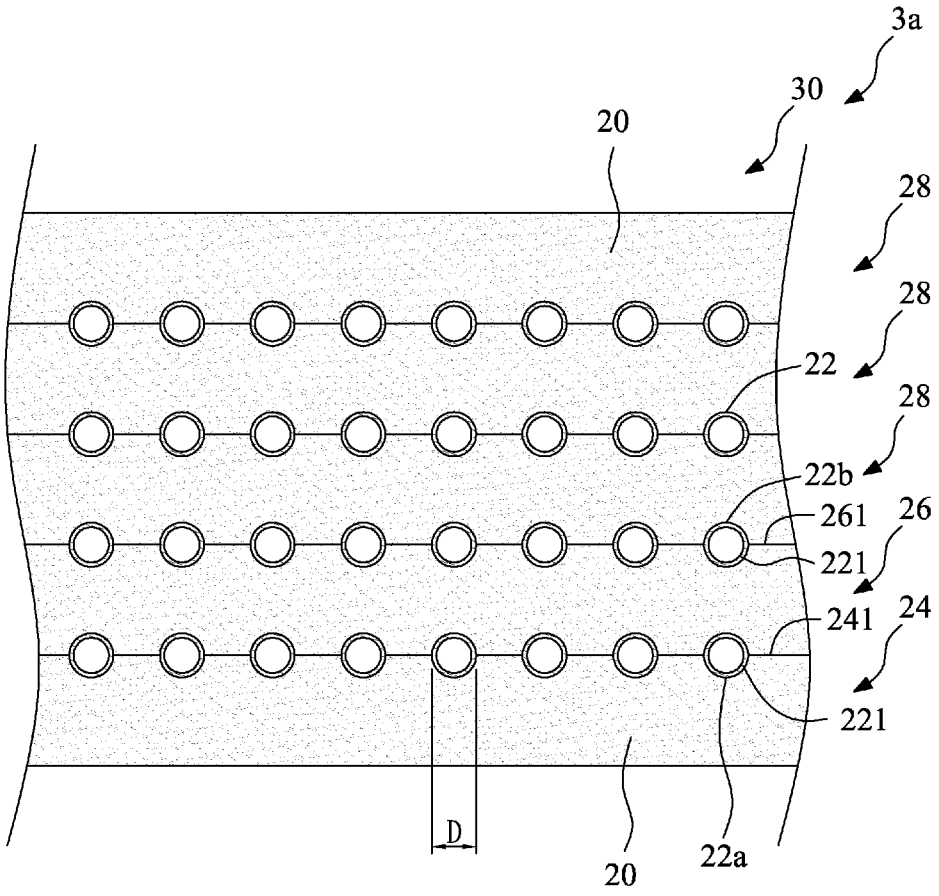

Referring to FIG. 12, the carrier 23 is removed, to form a polishing pad 3*a*.

FIG. 12 is a schematic cross-sectional view of a polishing pad according to another embodiment of the present invention. The polishing pad 3*a* comprises a polymeric elastomer 30 and a plurality of hollow structures 22, 22*a*, 22*b*. The hollow structures 22, 22*a*, 22*b* are uniformly distributed in the polymeric elastomer 30, and the sizes D of the hollow structures 22, 22*a*, 22*b* are substantially equal to each other. In this embodiment, the polymeric elastomer 30 is formed by curing a polymeric resin 20. The material of the polymeric resin 20 is selected from the group consisting of polyamide resin, polycarbonate, polymethacrylic resin, epoxy resin, phenolic resin, polyurethane resin, vinylbenzene resin and acrylic resin, and the material of the hollow structures 22, 22*a*, 22*b* is waterborne polyurethane or acrylic resin. In this embodiment, the material of the polymeric resin 20 is acrylic resin, for example, epoxy acrylate, urethane acrylate, polyester acrylate or polyether acrylate. The material of the hollow structures 22, 22*a*, 22*b* is waterborne polyurethane.

In this embodiment, each of the hollow structures 22, 22*a*, 22*b* is a capsule-like structure, which has a closed space formed by a shell 221. Preferably, the hollow structures 22, 22*a*, 22*b* are spherical. The sizes D of the hollow structures 22, 22*a*, 22*b* range from 10 μm to 100 μm, and the size variation between the hollow structures 22, 22*a*, 22*b* is within 20%. In this embodiment, the sizes D of the hollow structures 22, 22*a*, 22*b* range from 30 μm to 40 μm.

In this embodiment, the polymeric elastomer 30 includes a plurality of polymeric layers 24, 26, 28. Each two polymeric layers comprise one row of hollow structures, such that one portion of the hollow structure is located in an upper polymeric layer and the other portion of the hollow structure is located in a lower polymeric layer. For example, the first polymeric layer 24 and the second polymeric layer 26 comprise one row of first hollow structures 22*a*, such that one portion of the first hollow structure 22*a* is located in an upper polymeric layer (the second polymeric layer 26) and the other portion of the first hollow structure 22*a* is located in a lower polymeric layer (the first polymeric layer 24).

The above embodiments are only intended to describe the principle and the efficacies of the present invention, and are not intended to limit the present invention. Therefore, modifications and variations of the embodiments made by persons skilled in the art do not depart from the spirit of the present invention. The scope of the present invention should fall within the scope as defined in the appended claims.

What is claimed is:

1. A polishing pad, comprising:

a polymeric elastomer; and a plurality of hollow structures, uniformly distributed in the polymeric elastomer, wherein the sizes of the hollow structures are substantially equal to each other, the polymeric elastomer comprises a plurality of polymeric layers, and each two polymeric layers comprise one row of hollow structures, such that one portion of the hollow structure is located in an upper polymeric layer and the other portion of the hollow structure is located in a lower polymeric layer.

2. The polishing pad according to claim 1, wherein the polymeric elastomer is formed by curing a polymeric resin, the material of the polymeric resin is selected from a group consisting of polyamide resin, polycarbonate, polymethacrylic resin, epoxy resin, phenolic resin, polyurethane resin, vinylbenzene resin and acrylic resin, and the material of the hollow structures is waterborne Polyurethane or acrylic resin.

3. The polishing pad according to claim 1, wherein the hollow structures are capsule-like structures, the sizes thereof range from 10 μm to 100 μm, and a size variation between the hollow structures is within 20%.

4. A method for making a polishing pad, comprising the following steps:

(a) mixing a plurality of hollow structures into a polymeric resin, wherein the sizes of the hollow structures are substantially equal to each other, the hollow structures are distributed in the polymeric elastomer uniformly, and the hollow structures are charged;

(b) coating a portion of the polymeric resin onto a carrier, to form a first polymeric layer, wherein the first polymeric layer comprises at least one row of hollow structures, and an electric field is applied to cause the hollow structures to be arranged in the first polymeric layer;

(c) curing the first polymeric layer;

(d) coating a portion of the polymeric resin onto the first polymeric layer, to form a second polymeric layer, wherein the second polymeric layer comprises at least one row of hollow structures;

(e) curing the second polymeric layer; and (f) repeating the steps (d) to (e) at least once, to form a polishing pad.

5. A method for making a polishing pad, comprising the following steps:

(a) providing a polymeric resin, and coating a portion of the polymeric resin onto a carrier, to form a first polymeric layer;

(b) embedding a plurality of first hollow structures to an upper surface of the first polymeric layer, such that a lower portion of each of the first hollow structures is located in the first polymeric layer, and an upper portion of each of the first hollow structures is exposed from the first polymeric layer, wherein the sizes of the first hollow structures are substantially equal to each other, and the first hollow structures are distributed on the upper surface of the first polymeric layer uniformly;

(c) curing the first polymeric layer;

(d) coating a portion of the polymeric resin onto the first polymeric layer, to form a second polymeric layer, wherein the second polymeric layer covers the first hollow structures;

(e) embedding a plurality of second hollow structures to an upper surface of the second polymeric layer, such that a lower portion of each of the second hollow structures is located in the second polymeric layer, and an upper portion of each of the second hollow structure is exposed from the second polymeric layer, wherein the sizes of the second hollow structures are substantially equal to each other, and the second hollow structures are distributed on the upper surface of the second polymeric layer uniformly;

(f) curing the second polymeric layer; and (g) repeating the steps (d) to (f) at least once, to form a polishing pad.

* * * * *